United States Patent [19]

Oetiker

[11] Patent Number: 4,754,668

[45] Date of Patent: Jul. 5, 1988

[54] PINCER-LIKE TOOL

[76] Inventor: Hans Oetiker, Oberdorfstrasse 21, CH-8810 Horgen 2, Switzerland

[21] Appl. No.: 887,435

[22] Filed: Jul. 21, 1986

Related U.S. Application Data

[63] Continuation-in-part of Ser. No. 777,340, Sep. 18, 1985, Pat. No. 4,724,729.

[51] Int. Cl.[4] ..... B25B 27/00

[52] U.S. Cl. ..... 81/9.3; 29/268

[58] Field of Search ..... 81/9.3, 341, 415, 416, 81/421, 422, 423, 427.5, 394; 29/268, 243.56, 243.51, 243.5; 76/114, DIG. 6; 24/20 R, 20 EE, 23 EE, 273

[56] References Cited

U.S. PATENT DOCUMENTS

| | | | |
|---|---|---|---|
| 993,052 | 5/1911 | Griffen | 81/394 |
| 1,578,438 | 3/1926 | Hintz | 81/422 |
| 2,614,304 | 10/1952 | Oetiker | 24/20 R |
| 3,082,498 | 3/1963 | Oetiker | 24/20 R |
| 3,257,874 | 6/1966 | Madeira | 81/9.3 |
| 3,261,244 | 7/1966 | Smoyak | 81/417 |
| 3,709,073 | 1/1973 | Kurtz | 76/114 |
| 4,162,640 | 7/1979 | Arnold | 81/9.3 |
| 4,492,004 | 1/1985 | Oetiker | 24/20 R |

FOREIGN PATENT DOCUMENTS

| | | | |
|---|---|---|---|
| 14604 | 5/1956 | Fed. Rep. of Germany | 76/114 |
| 17445 | of 1905 | United Kingdom | 81/9.3 |

*Primary Examiner*—Roscoe V. Parker
*Attorney, Agent, or Firm*—Paul M. Craig, Jr.

[57] ABSTRACT

A pincer-like tool for tightening clamps of the type provided with overlapping band portions each including an outwardly projecting embossment that extends generally in the circumferential direction of the clamp and offers an engaging surface disposed substantially transverse to the circumferential direction and located at the end of the embossment remote from the free end of the respective band portion. The pincer-like tool includes two main standard pincer-like members of punched-out steel plate material each having a head section and a shank-like connecting section, two handle members fastened to a corresponding one of the connecting sections, a pivotal connection pivotally connecting the two standard pincer-like members with each other in an area intermediate the head section and the connecting section, a nose-like end portion at each head section of the standard pincer-like members, the two nose-like end portions being so arranged as to approach one another when the tool is actuated by displacing the handle members toward one another, and each nose-like end portion being provided with a tip projecting outwardly from its end face in such a manner that an abutment surface is formed by the end face adjacent the tip for engagement with the engaging surface of the embossment as the tip enters the embossment in the circumferential direction of the clamp during tightening thereof.

21 Claims, 8 Drawing Sheets

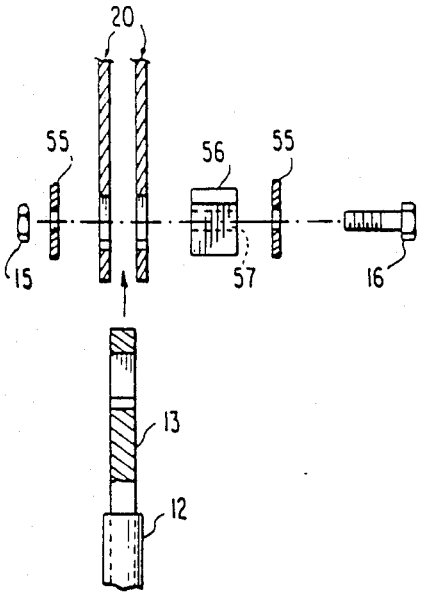
FIG. 4
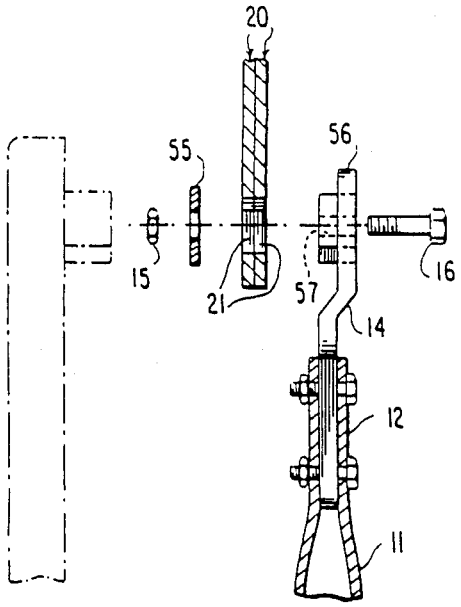
FIG. 5
FIG. 6
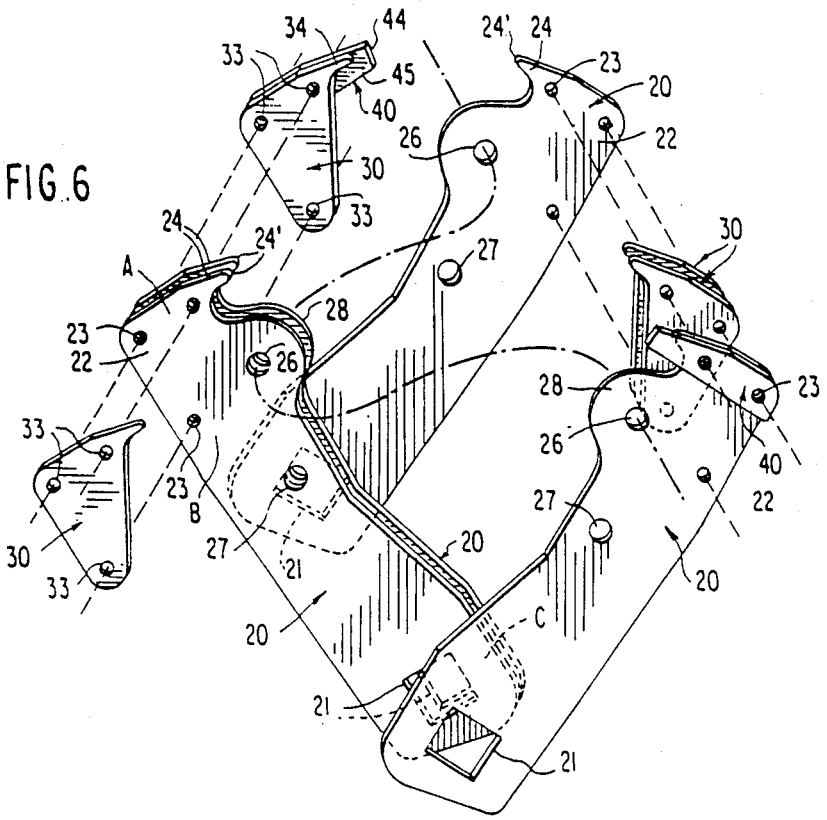

FIG. 13
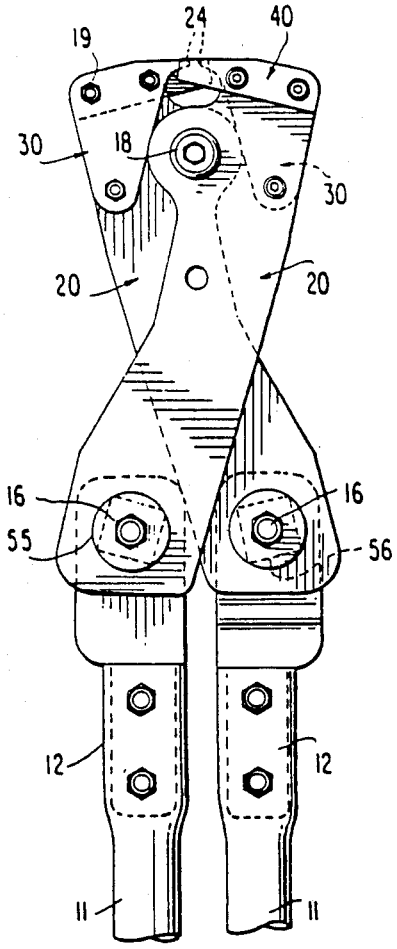
FIG. 14
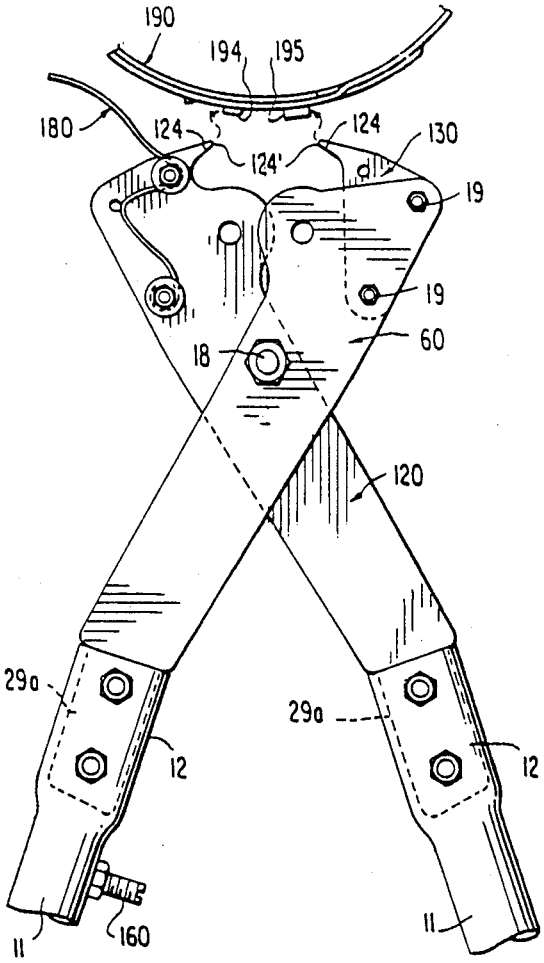
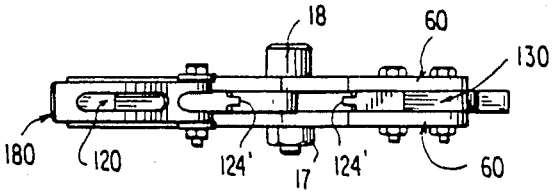
FIG. 15

FIG. 18
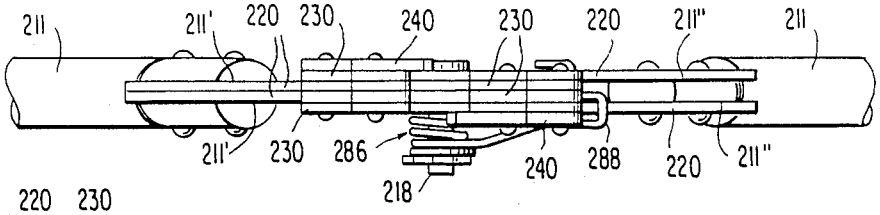
FIG. 19
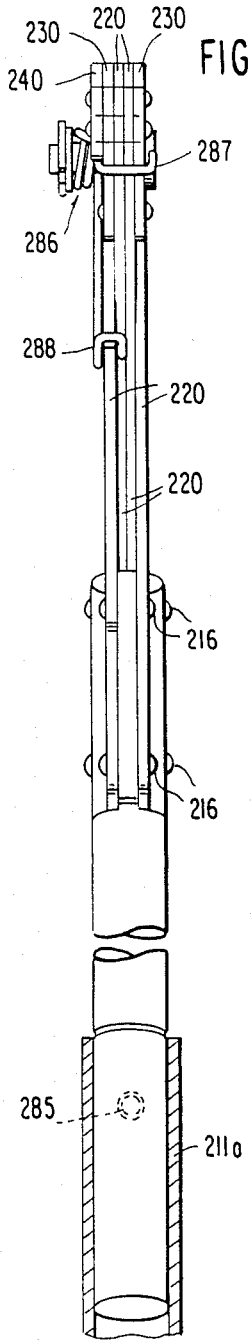
FIG. 21
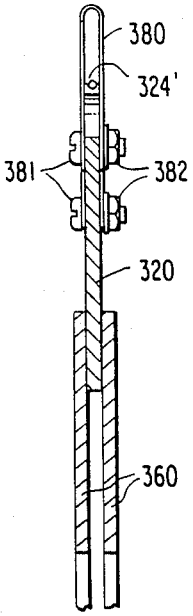
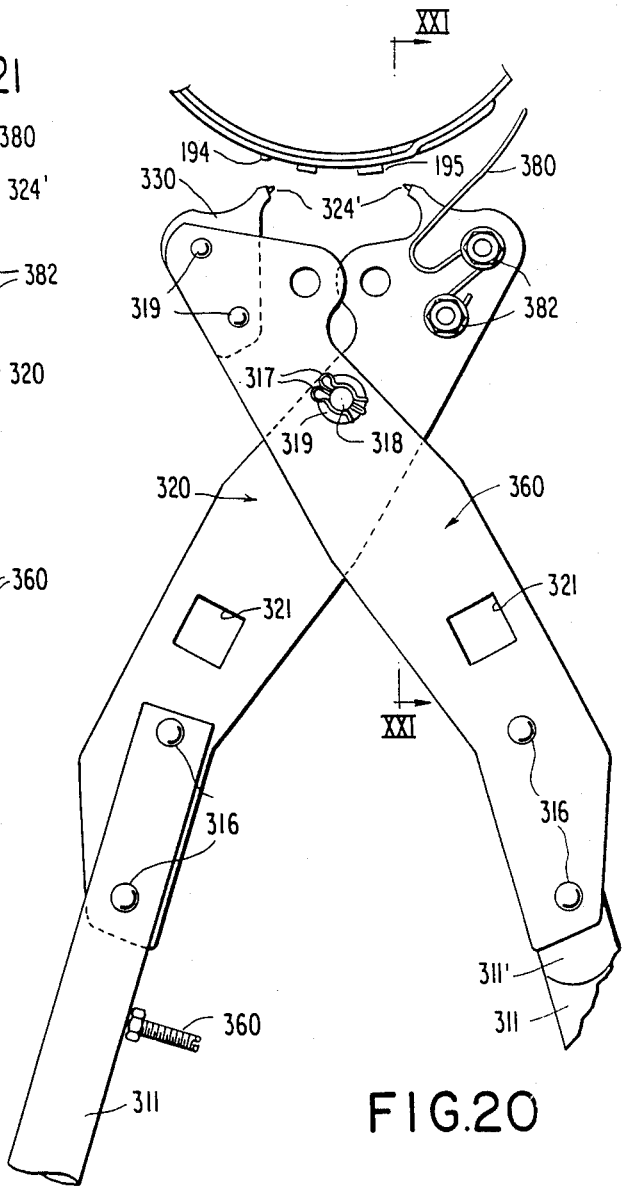
FIG. 20

FIG. 26
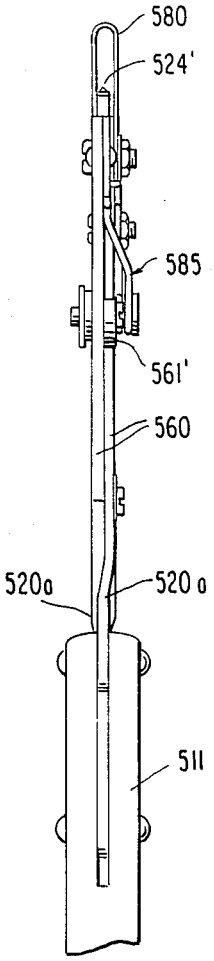
FIG. 25
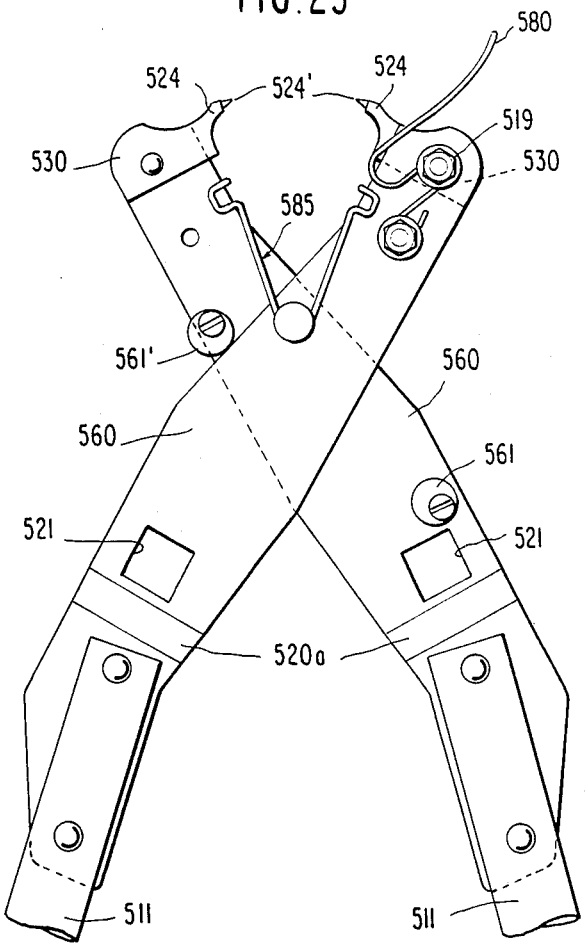
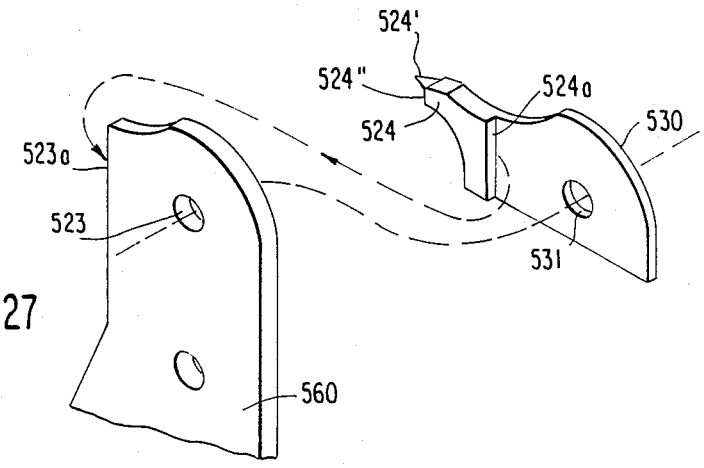
FIG. 27

PINCER-LIKE TOOL

This application is a continuation-in-part application of my prior application Ser. No. 777,340, entitled "Pincer-Like Tool", filed Sept. 18, 1985 and now U.S. Pat. No. 4,724,729.

The present invention relates to a pincer-like tool for tightening clamps with the use of standard stamped-out parts from steel plate material.

Conventional pincers with two short handles and grasping jaws working on a pivotal have been used heretofore for plastically deforming a so-called "Oetiker" ear in clamps of the type described, for example, in my U.S. Pat. Nos. 2,614,304 and 3,082,498. These types of pincers, made by forging, are relatively costly and likely to break under the application of very high forces necessary for reliably tightening certain clamps. Furthermore, these prior art pincers entail the disadvantage that the clamp might be destroyed during installation if the person incorrectly places the pincers over the ear so as to contact only a part of the ear with the jaws, thereby destroying the clamp.

Special tools were required heretofore to install earless clamps of the type disclosed, for example, in my prior U.S. Pat. No. 4,492,004. The pincer-like tools for tightening such clamps had to be specially made to provide small projecting tips at the jaws of the pincers capable of fitting into the circumferentially extending openings formed by outwardly extending embossments in the clamp. The manufacturing costs for such pincer-like tools were very high.

Moreover, it is frequently necessary to tighten the clamps with predetermined torque. Though so-called torquing keys are normally available in most repair shops, they could not be used with the prior art pincer-like tools.

Accordingly, it is the principal object of the present invention to provide a pincer-like tool which can be manufactured in a simple and relatively inexpensive manner and whose parts can be used to assemble different types of tools for tightening earless clamps as well as clamps provided with a so-called "Oetiker" ear.

The underlying problems are solved according to the present invention in that the pincer-like tool is assembled of standard parts, stamped-out from steel plate material of such shape and configuration that they can be readily assembled. Additionally, to permit use of the same parts for different applications, two holes are provided in the standard stamped-out parts for the pivotal connection thereof to permit optimum adaptation of the assembled pincer-like tool to the requirements of a given application. For example, relatively high torques are required to close so-called "Oetiker" ears while less force, but greater travel, of the jaws is required for tightening an earless clamp. This can be readily achieved according to the present invention by merely changing the point of pivotal connection in the standard parts.

Wrenches of laminated construction are known in the prior art from U.S. Pat. No. 3,709,073. However, the laminated wrench construction of this patent is for purposes of increasing strength and durability of the tool in which the various parts are bonded or welded together along their peripheral edges. Apart from the fact that a wrench does not include pivotally connected parts, the tool of this patent is for entirely different purposes and concerned with different problems.

The German Patent Application No. M 14 604 Ib/7c to Mueller et al. discloses a method for manufacturing pliers or similar tools which are assembled of a number of parts cut out of steel plating. However, the tool disclosed in this patent is not for tightening clamps and because of its configuration would be unsuited to close so-called "Oetiker" ears, not to mention its inability to close earless clamps of the type with which this invention is concerned.

According to another feature of the present invention, the pincer-like tool of this invention made from standard parts eliminates the problems encountered by incorrect application of the tool at the so-called "Oetiker" ear when tightening the clamp. According to another feature of this invention, the pincer-like tool is equipped with guide means constituted also by standard stamped-out guide parts which are provided on opposite sides of the jaws of the pincer-like members and which extend beyond the respective engaging surfaces so as to define a channel within which the ear must lie during closing.

If the standard stamped-out parts are assembled in accordance with this invention into a pincer-like tool for tightening earless clamps, sufficient guidance is provided according to still another feature of the present invention to confine the jaws to purely pivotal movement notwithstanding the relatively large travel of the jaws of the pincer-like tool during the closing operation.

To achieve closing pressures of more than 1,000 Kg with the use of average human strength, the pincer-like tool of my invention is provided with tubular extensions which, for example, can be pulled out so as to increase the leverage attainable with the tool. By increasing the leverage of the handle members, clamps made of heavier material can be fastened with predetermined higher pressures.

Furthermore, according to another feature of the present invention, conventionally available torque keys can be attached to the pincer-like tool of my invention where it is necessary to fasten the clamp with a predetermined pressure. For example, if the clamps are installed at the assembly line with predetermined pressure by the use of pneumatic pincers to effect a constant qualitatively perfect seal, the same installation can be duplicated in garages or other shops with the once-predetermined jaw pressure as had been used for the original installation at the assembly line. This assures that these installations have always been made with a very definite jaw pressure. This eliminates possible non-tightness due to insufficient jaw pressure or excessive deformation of the hose material in case of excessive jaw pressure. This is particularly important when clamping harder materials such as, for example, Hytrel. Conventionally available torque keys, used for fastening cylinder heads or other screws which need to be tightened with certain torque, can then be used also for tightening the clamps with predetermined jaw pressure.

According to still another feature of the present invention, a spring is provided on the pincer head used for fastening stepless earless clamps. This spring assures depressing the clamp end when installing an earless clamp so as to engage with the locking and support hooks. The tool then performs a function which otherwise would have to be performed by the fingers of the installer. The spring can thereby be easily matched to every size of the clamp to press down the outer end of the clamping band.

In a pincer-like tool consisting only of two unitary standard parts stamped out from steel plate material which include each the jaw portion and handle portion and which are pivotally interconnected with each other, it is necessary to provide two cranked or offset portions in each standard part to permit the pivotal connection with the jaw portions aligned. According to another feature of the present invention, cranked or offset portions can be eliminated by utilizing two standard flat parts in conjuntion with two standard jaw members which are so constructed and arranged that they can be assembled and fixedly held in place by the use of a single screw. Apart from extreme simplicity and low cost, it permits a saving in material as the jaw tips which are more likely to break, can be readily exchanged in case of need. Thus, in case of breakage at the tip of the jaw of the tool, the main standard part which is made of high grade steel can be re-used after the tip is interchanged.

To avoid damage to the nose-like tips of the pincer-like tool used for tightening earless clamps, a preferably adjustable stop is provided according to the present invention to limit the closing of the pincer-like tool. Furthermore, to limit the opening of such pincer-like tool, in order to facilitate installation of the clamp, another, preferably adjustable stop is provided according to the present invention which limits the maximum opening of the jaws of the pincer-like tool. These stops are conveniently in the form of eccentric disks which can be readily adjusted to the needs of a given situation.

These and other objects, features and advantages of the present invention will become more apparent from the following description when taken in connection with the accompanying drawing which shows, for purposes of illustration only, several embodiments in accordance with the present invention, and wherein:

FIG. 4 is an exploded view illustrating the connection between the main standard stamped-out parts of one side of the pincer-like tool with its actuating handle member;

FIG. 5 is an exploded view, similar to FIG. 4, illustrating the connection of the main standard stamped-out parts of the other side of the pincer-like tool with its actuating handle member;

FIG. 6 is an exploded view, illustrating the assembly of the stamped-out standard parts into the pincer-like members forming the jaws of the tool of FIG. 1;

FIG. 13 is an elevational view of the pincer-like tool of FIG. 1, with the two pincer-like members forming the jaws shown in the closed condition;

FIG. 14 is an elevational view, illustrating a pincer-like tool assembled from standard stamped-out parts for tightening earless clamps;

FIG. 15 is a top plan view on the pincer-like tool of FIG. 14;

FIG. 18 is a top plan view on the pincer-like tool of FIG. 16;

FIG. 19 is a partial right side elevational view of the pincer-like tool of FIG. 16;

FIG. 20 is a partial elevational view of a modified embodiment of a pincer-like tool in accordance with the present invention, similar to FIG. 14, for tightening earless clamps;

FIG. 21 is a partial cross-sectional view, taken along line XXI—XXI of FIG. 20;

FIG. 25 is a partial elevational view of a still further modified embodiment of a pincer-like tool in accordance with the present invention, similar to FIGS. 14, 20 and 23 for tightening earless clamps;

FIG. 26 is a partial side elevational view of the pincer-like tool of FIG. 25; and FIG. 27 is a perspective view, on an enlarged scale illustrating the assembly of the nose-like jaw member onto the standard part in accordance with the present invention.

Figure 1:
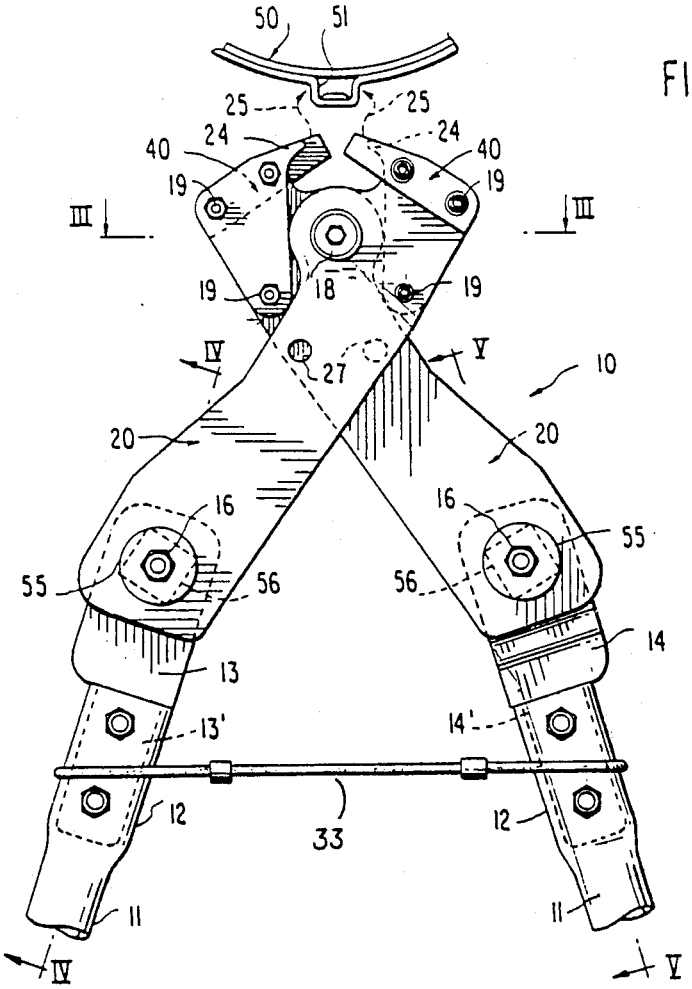
FIG. 1 is a partial elevational view of a pincer-like tool in accordance with the present invention for closing a so-called "Oetiker" ear in the course of tightening of clamps, with the parts thereof shown in the open position of the pincer-like tool.
Figure 2:
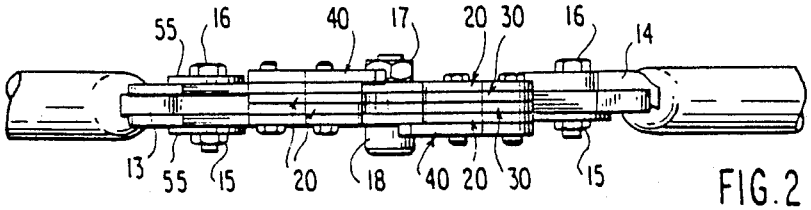
FIG. 2 is a top plan view of FIG. 1.
Figure 3:
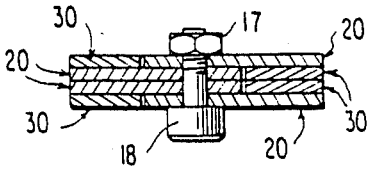
FIG. 3 is a cross-sectional view taken along line III—III of FIG. 1.

Referring now to the drawing wherein like reference numerals are used throughout the various views to designate like parts, the pincer-like tools generally designated by reference numeral 10 in FIG. 1 which is for tightening a clamp provided with a so-called "Oetiker" ear 51 includes two tubular handle members 11 which are connected with the pincer-like members, properly speaking, and assembled of stamped-out standard parts by way of extension members 13 and 14, the former being straight, and the latter having an offset. The handle members 11 are thereby easily fastened to the shank portions 13' and 14' of the extension members 13 and 14 by any appropriate means, for example, by riveted connections, by threaded connections and/or being deformed into flattened portions 12 as shown. Preferably, the tubular members 11 are made of solid steel or the like to withstand the very high forces which come into existence with relatively long actuating handles and are then fastened by any conventional means, such as rivets, bolts and nuts or the like. The pincer-like members forming the jaws of the tool are pivotally connected with each other by way, for example, of a pivot bolt 18 and nut 17 (FIG. 2) or by any other disengageable pivotal connection, such as a pivot member held in place by a cotter pin or the like.

Each pincer-like members is assembled of a number of standard parts stamped-out from steel plate material having a thickness of about 2 to 4 mm. In the pincer-like tool of FIG. 1, as can be seen in particular from FIGS. 2 and 6, one pincer-like member (the left in FIG. 2) is composed of two main standard parts generally designated by reference numeral 20 which are followed along each side by a standard stamped-out spacer member generally designated by reference numeral 30, while the other pincer-like member (the right in FIG. 2) is composed of two standard stamped-out spacer members 30 followed on each side by a main standard stamped-out part 20. A guide channel to assure correct emplacement of the pincer-like members over a so-called "Oetiker" ear is formed by the use of two standard cheek-like guide members generally designated by reference numeral 40, of which one is assembled onto one side of the pincer-like member and the other to the opposite side of the other pincer-like member. The standard parts constituting each pincer-like member are thereby assembled and fastened together by any appropriate means, for example, by riveted connections 19 or by threaded connections extending through appropriate holes provided in each of the standard stamped-out parts (FIG. 6).

Each main standard stamped-out part generally designated by reference numeral 20 thereby consists of a head section A followed by a center section B which is adjoined by a shank-like connecting section C. The configuration of the main standard part 20 can best be seen from FIGS. 6 and 9 which show the nose-like portions 24 of the head section A whose end faces 24' form the ear-engaging surfaces of the jaws. Two holes 26 and 27 are provided in the center section B for selectively providing two pivotal connections. A square opening 21 in the shank portion 29 permits the installation of the square lug of a standard torquing key. For normal use, a square insert 56 provided with a round hole 57 is used to connect the extension member 13, respectively, 14 with the main standard stamped-out parts 20 by the use of a bolt 16 and nut 15 or riveted under interposition of washers 55 (FIGS. 4 and 5). This permits not only the selective use of a torquing key but also allows a quick interchange of actuating handles of different length as needed.

Figure 8:
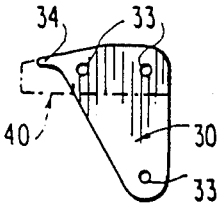
FIG. 8 is an elevational view of a standard stamped-out spacer member according to this invention also used in the pincer-like tools of the present invention.

The standard spacer member 30, best seen in FIGS. 6 and 8, generally conforms to the configuration of the head section A of the main standard part 20 and is provided with a similar nose-like end portion 34 as well as with similarly located fastening holes 33.

Figure 7:
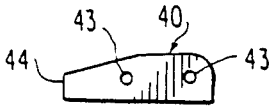
FIG. 7 is an elevational view, illustrating a standard stamped-out cheek-like guide member according to this invention, used with the pincer-like tool of FIG. 1.

The standard cheek-like guide member 40 (FIGS. 6 and 7) is provided with two fastening holes 43 spaced like the two top holes 23 and 33 of the main standard part 20 and of the standard spacer part 30. Its outer surface also generally conforms to the configuration of the outer surface of the main standard spacer parts. However, the guide member 40 extends beyond the nose-like end portions 24 and 34 so that it provides a guide surface 45 in its extension 44, whereby the two guide surfaces of opposite guide members form therebetween a channel assuring correct application of the pincer-like tool on a so-called "Oetiker" ear as indicated by arrows 25 in FIG. 1.

Thus, the pincer-like tool of the present invention illustrated in FIG. 1 permits a torque-key-like tightening of the clamps with the precisely accurate jaw pressure and at the same time avoids possible damages to the clamp or to the rubber material of the part to be fixed due to an improper application of the tool. The use of an elastic band 33 attached to the handle members 11 in certain cases holds the clamp in place, thereby facilitating fastening of the clamp after the clamp has been lodged in the pincer jaws by opening the same slightly.

Figure 10:
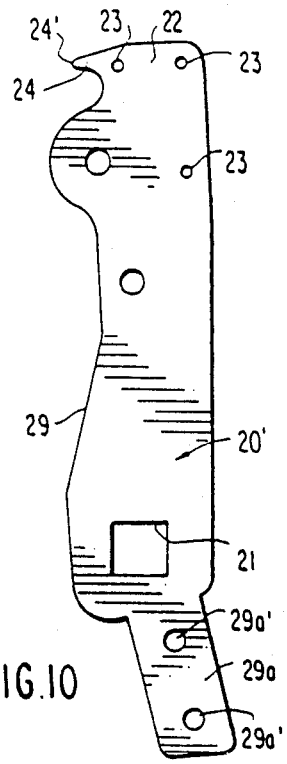
FIG. 10 is an elevational view, similar to FIG. 9, illustrating a modified embodiment of a main standard stamped-out part for use with the present invention.
Figure 12:
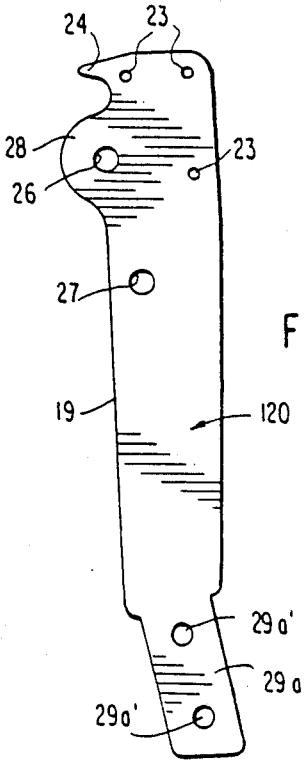
FIG. 12 is an elevational view of a modified embodiment of a main standard stamped-out part for use in the pincer-like tool according to the present invention.

FIG. 10 illustrates a main standard part 20' similar to main standard part 20 but modified to include an end portion **29*a* provided with fastening holes 29*a'*, as will be described more fully hereinafter in connection with FIG. 12, to eliminate the connecting portions 13 and 14 of FIG. 1**.

Figure 9:
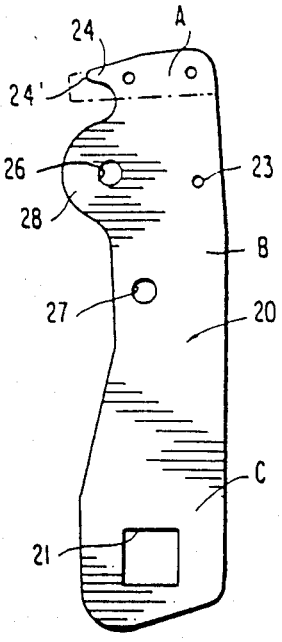
FIG. 9 is an elevational view illustrating the main standard stamped-out part used in pincer-like tools in accordance with the present invention.
Figure 11:
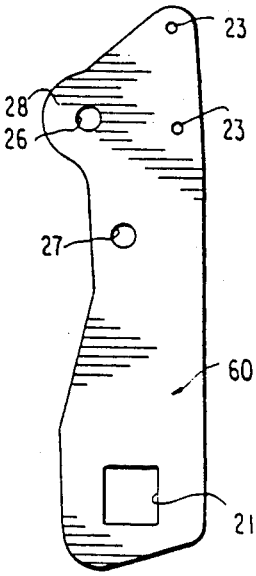
FIG. 11 is an elevational view of a modified main standard stamped-out part for use in assembling a pincer-like tool in accordance with the present invention for tightening earless clamps.

For purposes of closing an earless clamp of the type described, for example, in my U.S. Pat. No. 4,492,004, the pincer-like tool is assembled again of standard stamped-out steel parts. More specifically, such a pincer-like tool, illustrated in FIG. 14, includes a main standard pincer-like member generally designated by reference numeral 120 (FIGS. 12 and 14) and two modified main standard stamped-out parts 60 (FIGS. 14 and 15) spaced by means of a standard spacer part generally designated by reference numeral 130. The main standard stamped-out part 120 is generally similar to the main standard stamped-out part 20 but illustrates a connection between the main stamped-out part 120 and the tubular actuating handle member 11 of solid material without the need of an extension member, by the use of an end portion **29*a* provided with fastening holes 29*a'* (FIG. 12) with which the actuating handle member 11 is fastened by any conventional means. The modified main standard part generally designated by reference numeral 60 (FIG. 14) is similar to the main standard part 120 except that a portion corresponding to the head section A of FIG. 9, is cut off basically along a line tangential to the semi-circularly shaped projection 28 of the center section B as shown in FIG. 11, which shows such modified main standard part 60 for use with an extension member 13 or 14. Additionally, to provide the nose-like end portions 124 with tips 124' of sufficiently small size to fit into the pressed-out embossments 194 and 195 of the earless clamp 190 (FIG. 14), the nose portions 24 of the main standard part 20 and the nose portion 34 of the standard spacer part 30 is ground-off or otherwise machined, as shown in FIG. 15, so as to leave a shoulder on each side of the tip 124' as will be described more fully hereinafter in connection with FIG. 22**.

To provide a longer travel distance for the nose-like end portions 124, the pincer-like tool of FIGS. 14 and 15 utilizes the second holes 27 thereby reducing the lever arm for the force application but increasing the travel length. Additionally, the two modified main standard parts 60 provide a completely satisfactory guidance for the main standard part 120 during its pivotal movement to assure that the standard part 120 is limited to a pivotal movement without side movement which might hinder the tightening of the earless clamp. Furthermore, to prevent damage to the tips 124' of the nose-like end portions 124, when closing the pincer-like members in the absence of a clamp, one of the handle members 11 is provided with a preferably adjustable stop 160 limiting the closing of the tool.

To achieve different lengths for the actuating handle members, tubular members (not shown) may be fitted over the actuating handle members 11 of solid material which are held in place by conventional spring-loaded detent mechanisms provided in the solid handle members and which are able to engage in corresponding openings in the tubular members so as to fix their length position in different locations where these openings are provided, as will be described more fully hereinafter.

Moreover, the pincer-like tool for closing an earless clamp may be provided with a properly contoured spring member 180 suitably fastened to the main standard member 120. The spring 180 places the outer free end of the clamp down over the inner band portion during installation of the clamp to engage with the guide and support hooks, as shown in my aforementioned U.S. Pat. No. 4,492,004, whereby the clamp automatically assumes its closed condition without having to bring down the end by hand. During the disassembly, the pincer-like tool is merely rotated through 180° in order that the outer band end can be easily lifted out of the guide hook during the opening of the clamp. This permits removal of the clamp without destroying its reusability.

Figures 16, 17:
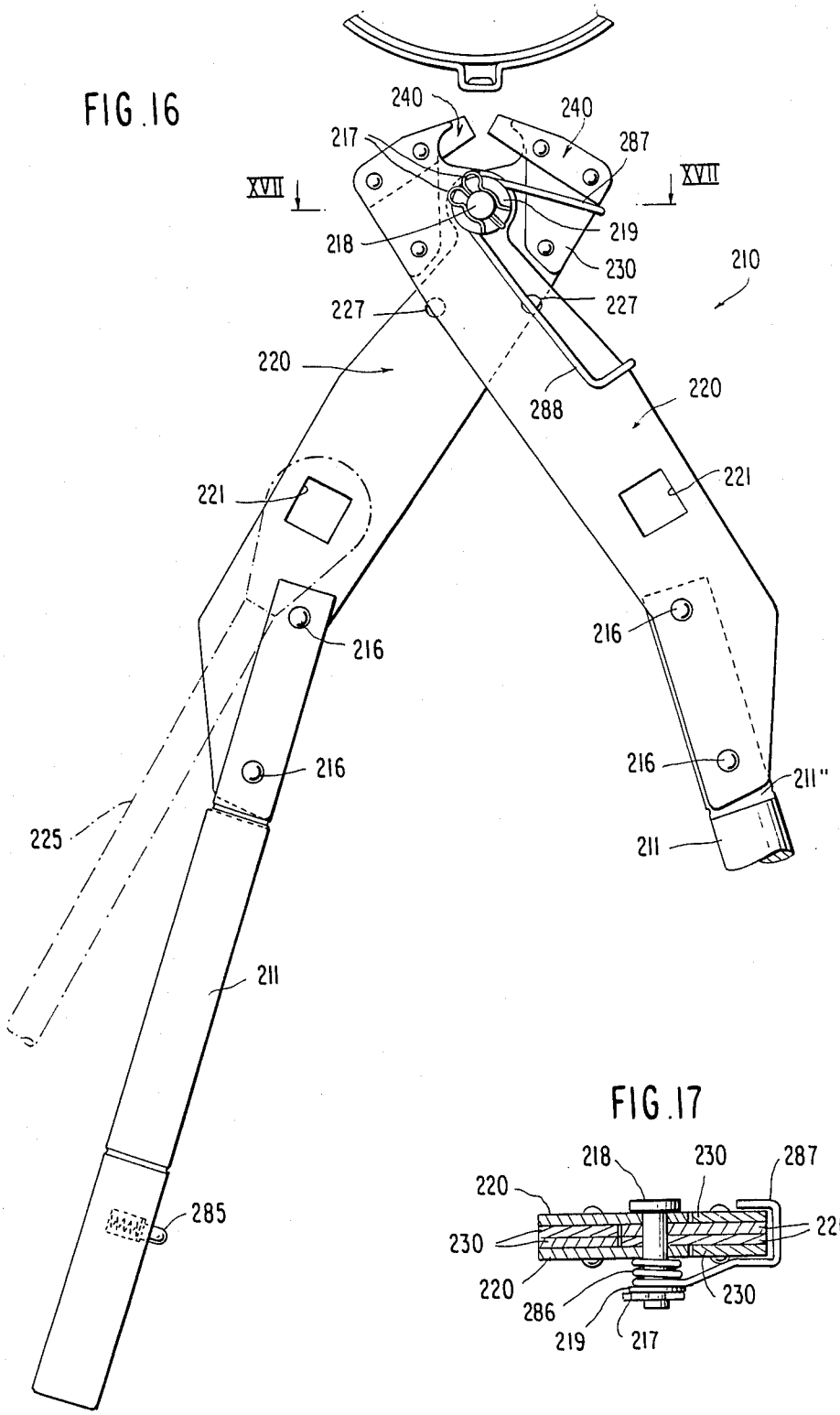
FIG. 16 is a partial elevational view, similar to FIG. 1, of a modified pincer-like tool in accordance with the present invention for closing a so-called "Oetiker" ear.
FIG. 17 is a cross-sectional view, taken along line XVII—XVII of FIG. 16.

A modified pincer-like tool, similar to the pincer-like tool of FIG. 1 for closing an "Oetiker" ear is illustrated in FIGS. 16–19 in which parts corresponding to those of FIGS. 1 through 6 are designated by corresponding reference numerals of the 200 series. For the sake of simplicity and brevity, only the differences of the embodiment of FIGS. 16 through 19 will be described in detail. The main standard parts generally designated by reference numeral 220 are connected without the interposition of extension members 13 and 14 with the handle members 211 of tubular construction. For that purpose, the tubular handle members 211 are slotted or flattened at their upper ends as indicated at 211' and 211" (FIG. 18) for connection with the lower extensions of the main standard parts 220 made from flat steel plate material. In lieu of threaded connections, riveted connections 216 can be used as each main standard part 220 is additionally provided with a rectangular opening 221 for insertion of a conventional torquing key indicated in dash and dotted lines and generally designated by reference numeral 225. In lieu of the elastic band 33, a coil spring generally designated by reference numeral 286 (FIGS. 17–19) is used which includes end sections 287 and 288 engaging around the main standard parts 220 as shown in FIG. 16 to urge the jaws of the pincer-like tool in the closing direction. Additionally, in lieu of the threaded connection 17, 18 of FIG. 1, the pivotal connection in the embodiment of FIG. 16 is realized by a stud pin 218 and cotter pins 217 engaging in corresponding holes of the stud pin 218 under interposition of a washer 219 between the coil spring 286 and the cotter pins 217. Reference numeral 285 generally designates a spring-loaded detent member (FIG. 16) to hold in place the tubular extension **211*a* (FIG. 19) by engagement in a correspondingly located hole provided in the latter when the tubular extension is to be used. In the non-used position, the detent member 285 holds the tubular extension 211*a* in place, slid over the handle member 211. FIG. 18 illustrates how the upper end portion of the left tubular handle member 211 is slotted to receive two main standard parts 220** while the corresponding upper end portion of the right tubular handle member is machined to provide the flattened surfaces externally.

FIGS. 20 and 21 illustrate a modified embodiment of a pincer-like tool of the type illustrated in FIG. 14. In the embodiment of FIGS. 20 and 21, parts corresponding to those of the embodiment of FIG. 14 are designated by similar reference numerals of the 300 series. For the sake of simplicity, again only those parts which differ from the embodiment of FIG. 14 will be described in detail. The main standard part 320 and the modified standard parts 360 are directly connected with the tubular handle members 311 in the manner shown in connection with the embodiment of FIGS. 16 through 19. Additionally, the pivotal connection between the main standard part 320 and the modified standard parts 360 is achieved by the use of a stud bolt 318, washer 319 and cotter pins 317. The spring 380 is again intended to depress the outer band portion over the inner band portion of the clamp so as to assist in the engagement of the guide and support hooks of the inner band portion in the corresponding openings of the outer band portion of the clamp.

Figure 22:
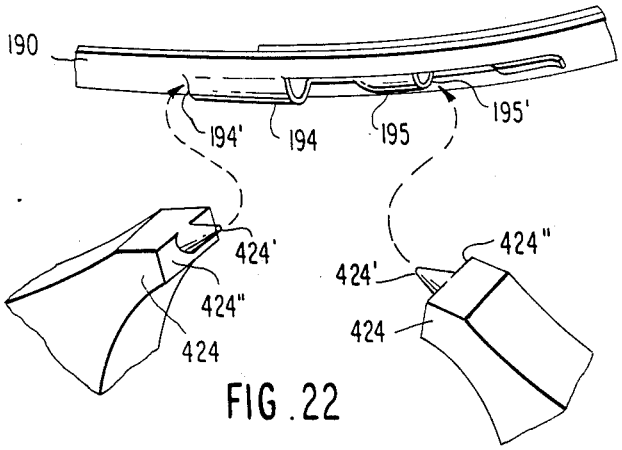
FIG. 22 is a partial perspective view, on an enlarged scale, of the nose-like end portions and tips of the pincer-like tool of FIGS. 14 and 20.
Figure 24:
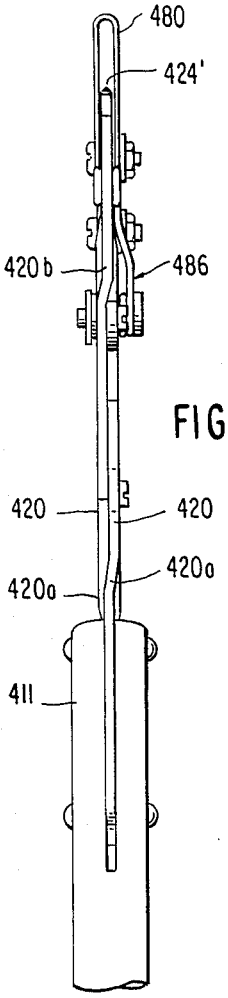
FIG. 24 is a side elevational view of the pincer-like tool of FIG. 23.
Figure 23:
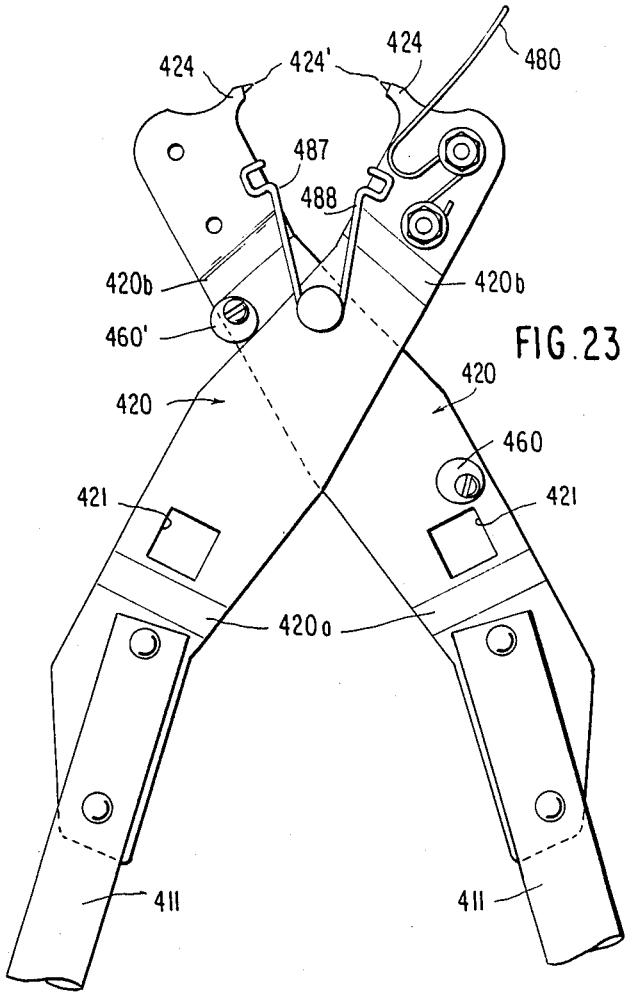
FIG. 23 is a partial elevational view of a pincer-like tool for tightening earless clamps, similar to FIGS. 14 and 20, but utilizing two standard parts stamped-out from steel plate material which are each provided with only one cranked portion.

FIGS. 22–24 illustrate a still further embodiment of a pincer-like tool in accordance with the present invention for installing an earless clamp of the type disclosed in my aforementioned patent. As only two main standard parts 420 are utilized in the pincer-like tool of this embodiment, each main standard part 420 is provided with two offsets **420*a* and 420*b* to permit a pivotal connection by any conventional means while the nose-like end portions 424 including the tips 424' travel in the same plane. The tips 424' which are intended to engage in the embossments 194 and 195 are of at least approximately complementary shape to the embossments 194 and 195. Since these embossments 194 and 195 are of approximately semi-circular shape, the tips 424' are also at least of approximately semi-circular shape along the outer surface of the tapering configuration thereof. Moreover, the tips 424' are so located in relation to the end face of the nose-like end portion that an abutment surface in the form of shoulder 424" remains for engagement with the engaging surfaces 194' and 195' of the embossments. A spring generally designated by reference numeral 486 which includes end portions 487 and 488, suitably engaging with the upper portion of the main standard parts 420, normally urges the pincer-like tool of FIG. 24** in the jaw-closing direction.

In lieu of the stop member 160, 360, an eccentrically mounted disk 460 is provided on the main standard part 420 above the square opening 421 to limit the closing movement of the pincer-like tool in order to protect the tips 424' from damage. For ease of installation, it is also convenient to provide a further eccentrically mounted disk 460' which limits the opening travel of the pincer-like tool so as to facilitate installation of the band clamp.

FIGS. 25 through 27 illustrate a still further modified embodiment in accordance with the present invention in which the offset **420*b* of the embodiment of FIG. 23 is eliminated. Parts corresponding to those of the embodiment of FIGS. 22 through 24 are designated in the embodiment of FIGS. 25 through 27 by corresponding reference numerals of the 500 series. Differing from the embodiment of FIG. 23, the main standard parts 560 are provided only with one offset 520*a* for connection with the corresponding handle members 511. This is made possible by the use of a separate standard part 530 similar in general shape to the part 130 of FIG. 14 but differing therefrom in the following respects. The nose-like end portion 524 is thicker than the main part of the member 530 including its hole 531 so as to form a flat shoulder 524***a* in the transition which abuts at the flat end face 523*a* of the main standard part 560. The parts are thereby so dimensioned that when the parts 530 and 560 are connected together by the use of a threaded connection engaging in holes 523 and 531, the shoulder 524*a* engages at the end surface 523*a*. A sturdy fixed connection is achievable thereby with the use of only a single threaded connection. As the stamped-out parts are normally made from high-grade steel plate material, and as the tips 524' are most likely to wear out first, it is only necessary to replace the part 530 with a new part in order to be able to reuse the remaining parts of the pincer-like tool. The stop disks are designated in this embodiment by reference numerals 561 and 561'.

The pincer-like tool of the present invention offers numerous advantages. First, it permits a rational and relatively inexpensive manufacture of pincer-like tools for different applications utilizing interchangeable standard parts stamped-out of steel material, especially high-grade steel. It permits the installation of normal clamps equipped with so-called "Oetiker" ears with much higher forces. The forces can be accurately controlled by the installation of auxiliary devices such as a torquing key. The same pincer-like members can also be connected to pneumatic actuating devices to provide the requisite high, accurately controlled pressure for the jaws. Similar standard stamped-out parts can also be used to assemble a pincer-like tool to install an earless clamp. Notwithstanding the simplicity of such pincer-like tool, the parts thereof are completely satisfactorily guided in their purely pivotal movement. Moreover, an incorrect application of the pincer-like tool to a so-called "Oetiker" ear is made impossible by the particular construction in accordance with the present invention utilizing cheek-like guide members defining therebetween a channel. Finally, the present invention also permits a rational repair of pincer-like tools for installing earless clamps which is cost-saving and simple.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A pincer-like tool for tightening clamps of the type provided with overlapping band portions each including an outwardly projecting embossment means that is pressed out of said overlapping band portion and extends generally in the circumferential direction of the clamp and offers an engaging surface disposed substantially transverse to the circumferential direction and located at the end of the embossment means remote from the free end of the respective band portion, comprising two main standard pincer-like members of punched-out steel plate material each having a head section and a shank-like connecting section, two handle members fastened to a corresponding one of the connecting sections, means pivotally connecting the two standard pincer-like members with each other in an area intermediate the head section and the connecting section, and further means fixed with said head section to provide a nose-like end portion at each head section of the standard pincer-like members, the two nose-like end portions being so arranged as to approach one another when the tool is actuated by displacing the handle members toward one another, and each nose-like end portion being provided with a tip projecting outwardly from its end face in such a manner that an abutment surface is formed by said end face adjacent said tip for engagement with the engaging surface of the embossment means as said tip enters the embossment means during tightening of the clamp.

2. A pincer-like tool according to claim 1, wherein said tip is of such a shape as to fit into the embossment means.

3. A pincer-like tool according to claim 2, wherein said tip is of an external configuration at least approximately complementary to the internal configuration of the embossment means.

4. A pincer-like tool according to claim 3, wherein said tip is of at least approximately partially cylindrical shape.

5. A pincer-like tool according to claim 4, wherein said tip tapers in the direction toward its free end.

6. A pincer-like tool according to claim 5, wherein said tip is at least approximately part conically shaped.

7. A pincer-like tool according to claim 6, wherein the end face of the nose-like end portion is provided with said abutment surfaces on both sides of the tip.

8. A pincer-like tool according to claim 1, further comprising stop means on one of the two parts consisting of pincer-like member and handle member for limiting the closing movement of the nose-like end portions to protect said tips.

9. A pincer-like tool according to claim 8, further comprising another stop means on one of said pincer-like members to limit the opening movement of the tool.

10. A pincer-like tool according to claim 9, wherein said stop means are in the form of disk-like members eccentrically mounted on at least one pincer-like member.

11. A pincer-like tool according to claim 1, further comprising a spring member fastened to and extending outwardly from a pincer-like member, said spring member being adaptable in its shape to be operable to engage with the outer band portion of the clamp.

12. A pincer-like tool according to claim 1, further comprising spring means urging the pincer-like members in their closing direction.

13. A pincer-like tool according to claim 1, wherein only two standard stamped-out pincer-like members are used.

14. A pincer-like tool according to claim 13, wherein said nose-like end portions are in one piece with the pincer-like members.

15. A pincer-like tool according to claim 13, wherein said nose-like end portions are constituted by separate parts stamped-out from steel plate material, each separate part including abutment surface means to securely seat such part against an end face of a respective pincer-like member when fastened thereto by a threaded means.

16. A pincer-like tool according to claim 15, wherein a single threaded means securely seats and fastens the separate part to said pincer-like member in a readily interchangeable manner.

17. A pincer-like tool according to claim 1, wherein said tip tapers in the direction toward its free end.

18. A pincer-like tool according to claim 17, wherein said tip is at least approximately part conically shaped.

19. A pincer-like tool according to claim 1, wherein the end face of the nose-like end portion is provided with said abutment surfaces on both sides of the tip.

20. A pincer-like tool according to claim 1, wherein said nose-like end portions are constituted by separate parts stamped-out from steel plate material, each separate part including abutment surface means to securely seat such part against an end face of a respective pincer-like member when fastened thereto by a threaded means.

21. A pincer-like tool according to claim 20, wherein a single threaded means securely seats and fastens the separate part to said pincer-like member in a readily interchangeable manner.

* * * * *